US005800077A

United States Patent [19]

March

[11] Patent Number: 5,800,077

[45] Date of Patent: Sep. 1, 1998

[54] METHOD AND APPARATUS FOR MONITORING A HYDROELECTRIC FACILITY TRASH RACK

[75] Inventor: Patrick March, Maryville, Tenn.

[73] Assignee: Tennessee Valley Authority, Muscle Shoals, Ala.

[21] Appl. No.: 700,316

[22] Filed: Aug. 19, 1996

[51] Int. Cl.[6] ..... E02B 1/00; E02B 9/00

[52] U.S. Cl. ..... 405/80; 405/78; 405/92

[58] Field of Search ..... 405/75–78, 80, 405/81, 92

[56] References Cited

U.S. PATENT DOCUMENTS

| | | | |
|---|---|---|---|
| 4,234,925 | 11/1980 | Kitano et al. | 364/494 |
| 4,319,320 | 3/1982 | Sato et al. | 364/165 |
| 4,486,381 | 12/1984 | Koji et al. | 376/210 |
| 4,683,718 | 8/1987 | Larsson | 60/327 |
| 4,770,843 | 9/1988 | Taleyarkham | 376/216 |
| 4,772,157 | 9/1988 | Obermeyer | 405/75 |
| 4,794,544 | 12/1988 | Albright et al. | 364/494 |
| 4,823,018 | 4/1989 | Kuwabara et al. | 290/7 |
| 4,994,684 | 2/1991 | Lauw et al. | 290/52 |
| 5,322,412 | 6/1994 | Erlach | 415/1 |
| 5,402,332 | 3/1995 | Kopf | 364/149 |

OTHER PUBLICATIONS

Daugherty et al., Fluid Mechanics With Engineering Application, 8th Edition, McGraw–Hill, Inc. pp. 231–240, 1985.

*Primary Examiner*—Tamara L. Graysay
*Assistant Examiner*—Tara L. Mayo
*Attorney, Agent, or Firm*—Foley & Lardner

[57] ABSTRACT

A system is provided for monitoring fouling of a trash rack for a hydroelectric power generation facility. The trash rack monitoring system includes sensors for detecting head upstream and downstream of a trash rack as well as the flow through an inlet conduit downstream of the rack. The head and flow values are used to generate a trash rack loss coefficient that reflects actual losses across the trash rack independent of flow rate. A corresponding coefficient may be calculated when the rack is clean and used as a reference value for determining the additional loss across the rack due to fouling. The loss value may be converted to an economic loss value. The coefficient and economic loss values may be displayed on an operator interface and may serve as the basis for an alarm indicating the need to clean the rack or the potential for rack failure.

21 Claims, 3 Drawing Sheets

METHOD AND APPARATUS FOR MONITORING A HYDROELECTRIC FACILITY TRASH RACK

BACKGROUND OF THE INVENTION

The present invention relates generally to ameliorating performance of a hydroelectric facility through improved monitoring of the fouling of the facility trash rack. In particular, the invention relates to detecting parameters indicative of losses across the trash rack and utilizing these parameters to determine when the losses reach unacceptable levels, indicating that corrective measures, such as manual or automatic cleaning of the rack, should be undertaken.

It is common practice in the art of hydroelectric power generation to provide a debris screening structure, commonly referred to as a trash rack, upstream of turbine intake conduits to stop large objects from entering into the conduits and potentially fouling or damaging the turbine machinery. Such trash racks are typically formed of a series of vertical or inclined, parallel pipes or bars anchored to the upstream face of a dam, or to the base of the dam, and extending to a height which may be above the headwater elevation. Objects and debris flowing with stream currents and pulled toward the intake conduits are stopped by the rack and retained upstream until physically removed by manual or mechanized rakes or other cleaning equipment.

A problem with conventional trash rack installations is their tendency to accumulate significant quantities of debris, ultimately resulting in operational problems associated with partial or complete trash rack failure (e.g., collapse) or significant head losses that negatively impact the productivity of the power generating facility. This negative impact is felt in terms of reduced power production, reduced operability, reduced availability and, consequently, in terms of lost revenue. For example, it is estimated that at one 5-turbine unit 175 MW river hydroelectric plant, trash rack losses of one foot of head represent an annual revenue loss of $500,000.00 at an energy value of $25.00 per MWh.

While various systems have been proposed for monitoring head losses across trash racks, these have not proven entirely satisfactory. For example, existing techniques do not accurately reflect real losses across the trash rack as flow rate through the rack changes, making loss data difficult to interpret. Moreover, known systems have not been integrated effectively in an overall control scheme designed to alert operations personnel of the need to clean the trash rack, typically relying on spot checking or periodic cleaning schedules.

There is a need, therefore, for an improved system for monitoring fouling of trash racks in hydroelectric facilities, and for informing plant personnel of the real state of losses across the rack, both in terms of head loss and in terms of economic impact, and for informing operations engineering and management personnel of the potential for trash rack failure due to excessive head losses.

SUMMARY OF THE INVENTION

The present invention features a novel technique for monitoring parameters associated with trash rack fouling designed to respond to these needs. The technique is applicable to all types of turbine facilities and may be retrofitted on existing equipment. By sensing head, or a parameter indicative of head on either side of the trash rack the technique determines head loss across the rack. This head loss then serves as the basis for a calculation of a trash rack loss coefficient that provides an indication of real fouling independent of flow rate. In a particularly preferred embodiment, the losses thus calculated are converted into an economic cost based upon the actual or assumed energy cost, and are displayed for operations personnel or used to generate an alarm or flag indicating the need to clean the rack and potential for trash rack failure.

Thus, in accordance with a first aspect of the invention, a method is provided for monitoring losses in a hydroelectric power generation facility of the type including a turbine driven power generating unit receiving flow through an upstream conduit and a trash rack disposed upstream of the conduit to prevent debris from flowing into the unit. The method includes the steps of monitoring a first parameter representative of head loss across the trash rack, monitoring a second parameter representative of flow rate through the conduit, and deriving a trash rack loss parameter from the first and the second parameters.

In accordance with a preferred form of the method, a first parameter is detected that is representative of head upstream of the trash rack, a second parameter is detected that is representative of head downstream of the trash rack and a third parameter is detected that is representative of flow rate through the inlet conduit. A trash rack loss coefficient is derived from the first, second and third parameters, and provides an indication of head loss across the trash rack independent of flow rate through the conduit. The trash rack loss coefficient is preferably directly proportional to the differential head across the rack and inversely proportional to the square of the flow rate. Moreover, the coefficient may be compared to a similar coefficient generated when the trash rack is clean or calculated for a clean trash rack, thereby providing an indication of additional losses due to trash rack fouling. The comparison may also be used to generate an indication of the economic cost of the additional losses.

The invention also provides a system for monitoring losses in a hydroelectric power generation facility of the type mentioned above. The system includes a plurality of sensors coupled to a controller. A first sensor detects a first parameter representative of head upstream of the trash rack and generates a first signal representative thereof. A second sensor detects a second parameter representative of head downstream of the trash rack and generates a second signal representative thereof A third sensor detects a parameter representative of flow through the inlet conduit and generates a third signal representative thereof The controller is coupled to the first, second and third sensors, and processes the first, second and third signals to derive a trash rack loss signal representative of head loss across the trash rack.

BRIEF DESCRIPTION OF THE DRAWINGS

The present invention will become more fully understood from the following detailed description, taken in conjunction with the accompanying drawings, wherein like reference numerals refer to like parts, in which.

DESCRIPTION OF THE PREFERRED EMBODIMENTS

Figure 1:
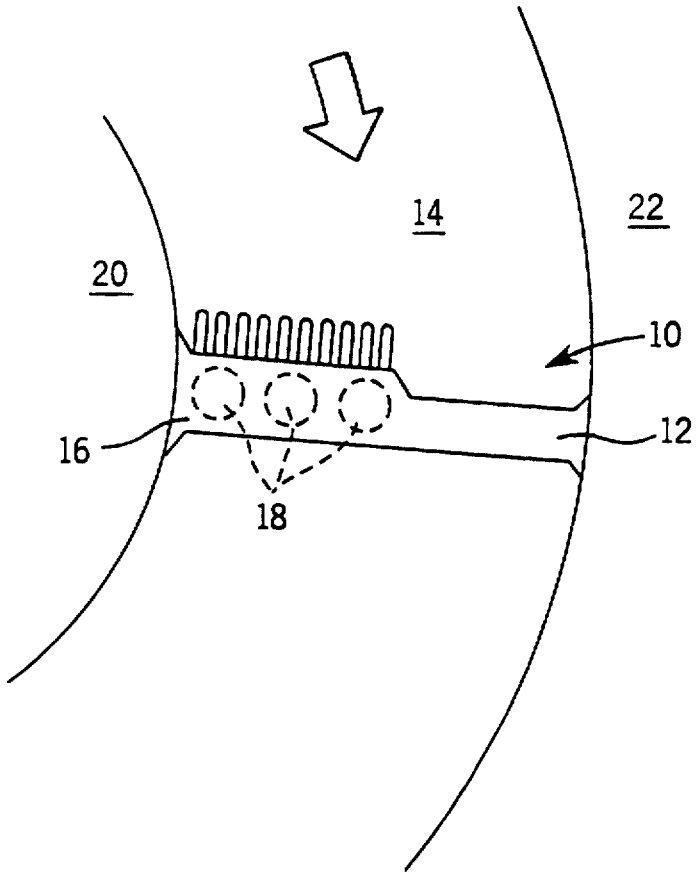
FIG. 1 is an exemplary perspective view of a turbine power generating facility including several turbine units across a section of a stream.

Turning now to the drawings and referring to FIG. 1, a hydroelectric power generating installation 10 is illustrated generally, including a dam 12 spanning a stream 14, and a power generating facility 16. In the exemplary installation illustrated, facility 16 includes a series of three Kaplan turbine generating units, designated generally by the reference numeral 18. As will be understood by those skilled in the art, facility 16 may include more or fewer generating units 18, and such units may be situated adjacent to one or both banks 20, 22 of stream 14, or at various locations between the banks. Moreover, while the following discussion makes reference to a Kaplan turbine by way of example, the present invention is not limited to application with any particular type of turbine unit. In operation, facility 16 generates electrical power by permitting water to flow through turbine units 18, and outputs the generated power on a power distribution grid (not represented).

Figure 2:
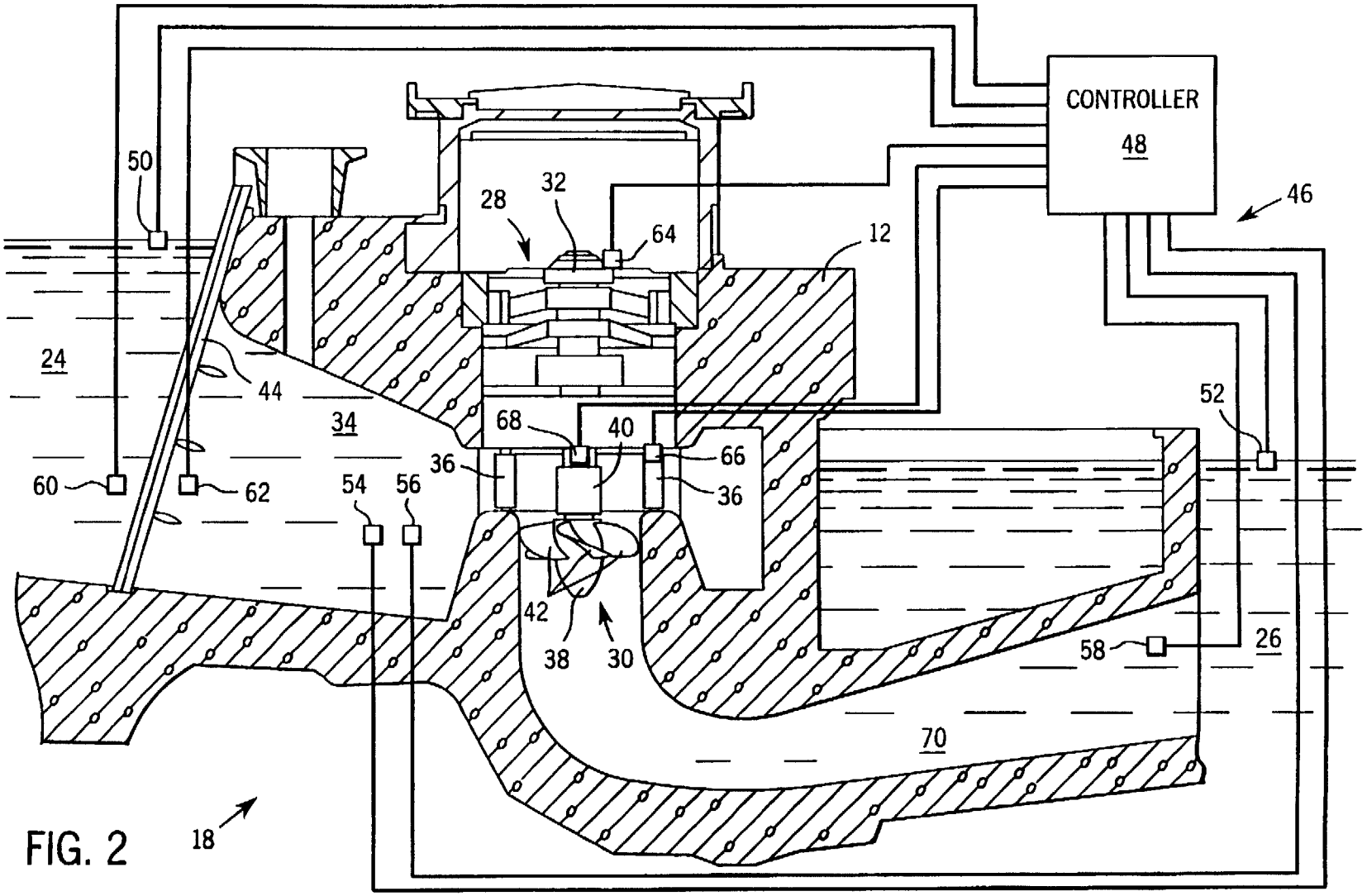
FIG. 2 is a diagrammatical representation of a turbine installation illustrating exemplary instrumentation for monitoring losses across a trash rack in accordance with the invention.

Each turbine unit 18 may be of generally known design, such as the vertical Kaplan turbine as illustrated diagrammatically in FIG. 2, for generating electrical power as water is allowed to flow through dam 12 from a headwater reservoir 24 of stream 14 to a tailwater side 26. Thus, unit 18 includes a turbine support superstructure 28 built within dam 12. Superstructure 28 provides axial and radial support for a turbine 30 and electrical generator 32. For the illustrated power generating unit, turbine 30 is positioned within the flow path of stream 14, downstream of an inlet conduit 34 and movable wicket gates 36. Turbine 30 includes a runner 38 supported on a vertical shaft 40 and having a plurality of movable blades 42 disposed around its periphery for driving shaft 40 and generator 32 in rotation as water flows through dam 12 from headwater 24 to tailwater 26. Unit 18 also includes a trash rack 44 upstream of inlet conduit 34, typically comprising parallel, spaced-apart bars, for preventing large objects and debris from fouling or damaging turbine 30. A mechanical cleaning system may be provided atop superstructure 28 for removing debris accumulated upstream of trash rack 44. Alternatively, facility 16 may employ manual methods (e.g., rakes) for removing debris from trash rack 44 when required.

In the preferred embodiment illustrated in FIG. 2, unit 18 includes a control system, designated generally by the reference numeral 46, including a number of sensors 50, 52, 54, 56, 58, 60, 62 and 64 and actuators 66 and 68 coupled to a controller 48 by appropriate data links. For the purpose of controlling operation of unit 18 and monitoring losses across trash rack 44, the sensors of control system 46 preferably permit detection of a set of operating parameters, including differential head from headwater 24 to tailwater 26, power generation level, flow through unit 18, cavitation, and trash rack head loss. While a number of alternative method are known in the art for directly or indirectly measuring these parameters, preferred sensing devices include the following. Stilling well-type transducers 50 and 52 measure the relative elevation or height of headwater and tailwater 24 and 26, respectively. Such measurements are used to determine the drop in head across dam 12 and for determining the submersion factor ($\delta$) of the turbine as an indication of the risk of cavitation within turbine 30. The submersion level is generally determined as a function of the difference between the tailwater elevation and a reference elevation for turbine 30 in a manner well known in the art. Sensor 54, positioned, where feasible within inlet conduit 34, is a pressure transducer providing a signal proportional to head upstream of turbine 30, accounting for head losses between headwater 24 and gates 36. Where unit 18 has a relatively short inlet conduit 34, sensor 54 may be situated near its entry. Reference numeral 56 represents a sensor assembly positioned within inlet conduit 34 for generating a signal indicative of flow through unit 18. In the preferred embodiment, flow is determined by the well known Winter-Kennedy method, although alternative methods could be substituted, including the Peck method. Sensor 58, provided in the draft tube 70 of unit 18, is a pressure transducer similar to sensor 54 generating a pressure measurement signal and isolating losses from turbine 30 to tailwater 26. Sensors 60 and 62 are pressure transducers generating pressure measurements on either side of trash rack 44, and providing an indication of head loss across trash rack 44. Alternatively, trash rack losses could be indicated by measurements of headwater level (e.g., from sensor 50) and inlet head (e.g., from sensor 54). Finally, reference numeral 64 represents a power monitor providing a continuous signal indicative of the level of power being generated by unit 18.

In addition to the sensors described above, control system 46 is typically provided with actuator assemblies 66 and 68 for orienting gates 36 and blades 42 at desired positions. Actuator assemblies 66 and 68 may be of any suitable type known in the art, such as assemblies including hydraulic cylinders or motors coupled to mechanical linkages for effectuating the desired movement of the gates and blades and for holding the gates and blades in the desired positions against the force of impinging flow through unit 18. Moreover, actuator assemblies 66 and 68 also include sensors, such as potentiometers, linear variable differential transformers or the like, for providing feedback signals indicative of the actual positions of gates 36 and blades 42.

Signals from the various sensors outlined above are applied to controller 48, which also serves to generate control signals for commanding actuator assemblies 66 and 68 to position gates 36 and blades 42 in desired orientations. In the presently preferred embodiment, controller 48 includes an appropriately configured programmable logic controller executing a cyclic control routine stored in resident memory. Moreover, controller 48 is preferably also linked to other turbine units 18 within facility 16. Thus, where the other units 18 within facility 16 are comparably instrumented, controller 48 receives signals indicative of the operating parameters of all units 18 in facility 16, and controls operation of all gates and blades in the various units.

For the particular purpose of monitoring losses across trash rack 44, facility 16 is preferably instrumented as follows. When the structure of facility 16 permits, it is preferred to measure differential head across trash rack 44 via sensors 60 and 62 located as closely adjacent to trash rack 44 as possible to isolate the effects of other (i.e., non-trash rack) losses. In some facilities, however, it may be acceptable or necessary to base estimates of trash rack losses on headwater level (as measured by sensor 50) and on an output of a suitable piezometer positioned within inlet conduit 34. Ultimately, however, when the present technique and system are retrofitted to existing facilities, the particular instrumentation options may be limited by the facility design. As discussed below, the present technique should not be considered to be limited to any particular instrumentation, but more generally requires some form of instrumentation for detecting pressure drop across trash rack 44 and flow through inlet conduit 34.

Figure 3:
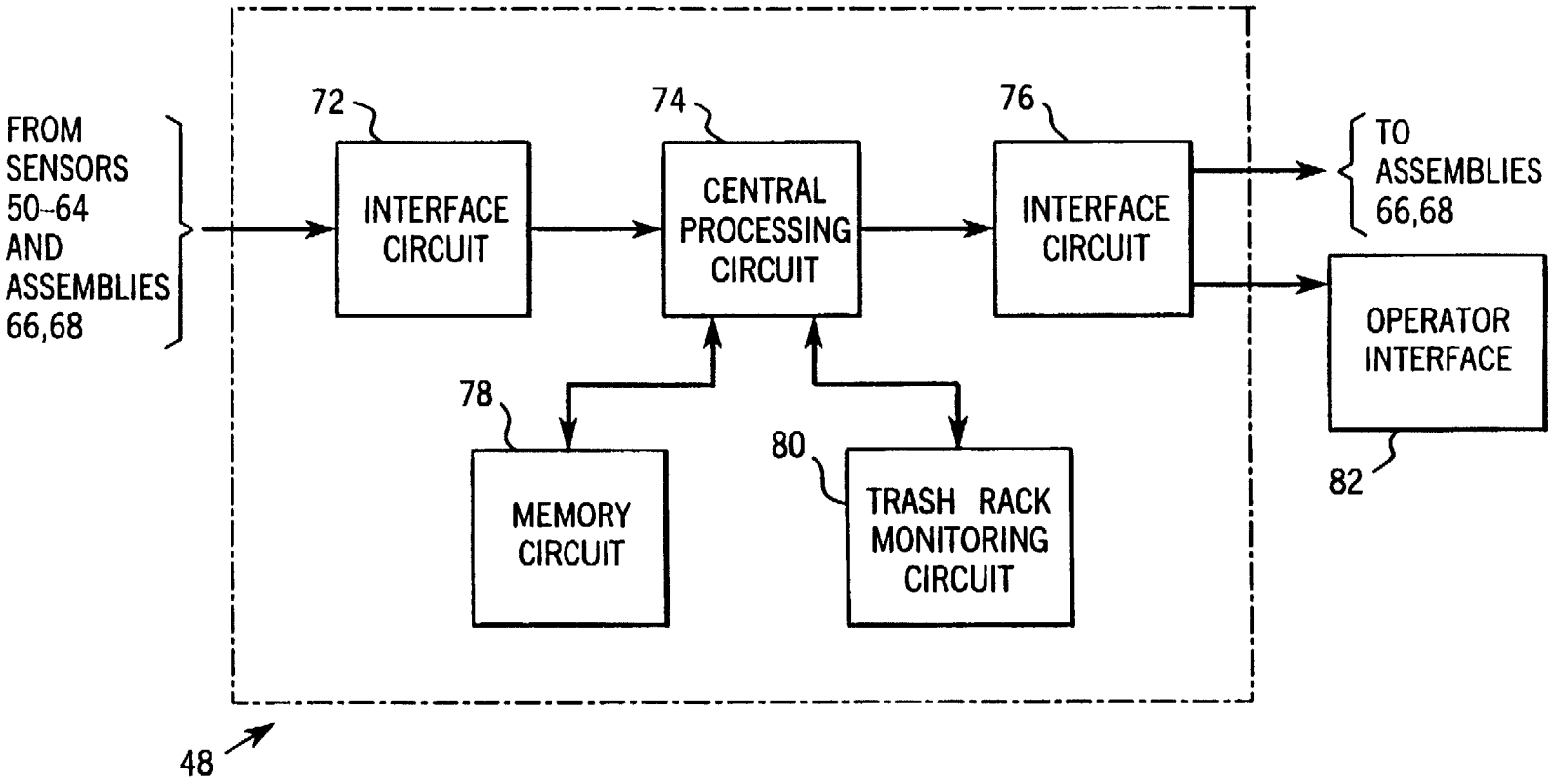
FIG. 3 is a block diagram of certain of the functional circuits in the control system illustrated in FIG. 2 for monitoring and analyzing trash rack losses.

FIG. 3 is a general block diagram of certain functional circuits included in controller 48 when programmed to execute a trash rack loss monitoring technique as described below. Controller 48 includes an interface circuit 72, a central processing circuit 74, an interface circuit 76, a memory circuit 78 and a trash rack monitoring circuit 80. Interface circuit 72, which typically includes appropriate multiplexing, analog-to-digital converting and signal conditioning circuitry receives operating parameter signals from sensors 50–64 and feedback signals from actuator assemblies 66 and 68, and applies these signals to central processing circuit 74. Similarly, interface circuit 76, which typically includes appropriate signal conditioning circuitry, receives control signals from central processing circuit 74 and commands corresponding servo movement of gates 36 and blades 42. Moreover, interface circuit 76 communicates control signals from central processing circuit 74 to an operator interface 82 for displaying operating conditions, such as the head loss across trash rack 44 or a cost value associated with current trash rack losses. Operator interface 82, which will typically include a computer monitor situated in a control station (not shown) for facility 16 may also display or sound visual or audible alarms, such as when trash rack losses exceed predetermined threshold levels as described below.

Central processing circuit 74 is also linked to memory circuit 78 and trash rack monitoring circuit 80. In operation, central processing circuit 74 executes a cyclical control routine stored within memory circuit 78 for controlling operation of facility 16. As described more fully below, based upon the head and flow related signals applied to central processing circuit 74, trash rack monitoring circuit 80 generates trash rack loss values and communicates these values to central processing circuit 74.

As will be appreciated by those skilled in the art, the functional circuitry represented in FIG. 3 may be defined by standard input/output circuitry, memory circuitry and programming code in a standard programmable logic controller, personal computer, computer workstation or the like. For example, in the presently preferred embodiment, central processing circuit 74, in the form of a programmable logic controller dedicated to facility 16, is provided with resident memory for executing a main control routine. Trash rack monitoring circuit 80 is preferably a portion of the main control routine, or may comprise a separate software module retrofitted to the main control routine.

In accordance with a preferred embodiment of the invention, controller 48 calculates losses across trash rack 44 as follows. When sensors 60 and 62 are available in facility 16 for detecting parameters representative of the pressure differential across trash rack 44, trash rack monitoring circuit 80 calculates a trash rack head loss parameter or coefficient in accordance with the relationship:

$$K_T=2g(A_T)^2(H_1-H_2)/Q^2 \quad (1);$$

where $K_T$ is the trash rack loss parameter, g is a gravitational constant, $A_T$ is an intake flow area for the trash rack, $H_1$ is the head immediately upstream from the trash rack, $H_2$ is the head immediately downstream from the trash rack and Q is the intake volumetric flow rate. Referring to the diagrammatical view of FIG. 2, the intake flow area utilized in equation 1 will be known for facility 16 and generally corresponds to the cross sectional area of the inlet conduit at the location of sensor 62. As mentioned above, the flow rate through the inlet conduit may be measured or calculated in a variety of known ways, such as the Winter-Kennedy method.

When facility 16 includes net head taps or other suitable piezometer instrumentation in inlet conduit 34 downstream of trash rack 44, the trash rack head loss coefficient may be calculated using the headwater elevation as detected by sensor 50, in accordance with the relationship:

$$K_T=2g(A_T/Q)^2(HW-H_3)-(A_T/A_I)^2(1+K_I) \quad (2);$$

where HW is the headwater elevation, $A_I$ is the inlet conduit flow area at the location of the head tap or piezometer, $H_3$ is the piezometric head in the inlet conduit and $K_I$ is an intake loss coefficient representative of losses between a point adjacent to the trash rack (e.g., the location of sensor 62) and the location of the piezometer. The latter coefficient is preferably measured for the particular installation or may be predicted analytically in a manner known by those skilled in the art.

The resulting trash rack loss coefficients provide an indication of head loss across trash rack 44 independent of flow through the trash rack. Trash rack monitoring circuit 80 preferably determines the trash rack coefficient periodically and communicates the resulting coefficient to circuit 74 for storage in memory circuit 78. By accessing historical trash rack coefficients thus stored in memory circuit 78, circuit 74 may output trending values to operator interface 82, such as for graphically displaying losses due to trash buildup over time. Moreover, trash rack monitoring circuit 80 preferably generates a reference trash rack loss coefficient when trash rack 44 is clean. Subsequently, by comparing current coefficient values to the reference clean value, controller 48 preferably determines a cost value associated with additional head loss across the trash rack due to fouling. This cost value R is preferably generated in accordance with the relationship:

$$R=[(K_T-K_C)(Q/A_T)^2PE]/[2g(HW-TW)_{avg}] \quad (3);$$

where $K_C$ is an intake loss coefficient for the trash rack when clean, P is the average annual energy production for the facility, E is an economic energy unit cost, and $(HW-TW)_{avg}$ is the average gross head for the facility. In general, the average annual energy production and average gross head will be known for facility 16. The unitary energy cost may be estimated based upon an average value or may be accessed in real time, such as via a wide area network, modem or other telecommunications link. In the latter case, the unit cost value may change over time, reflecting the current market value for energy produced by the facility. By periodically calculating this cost value and storing successive values in memory circuit 78, controller 48 may display trending plots for current and accumulated costs of trash rack fouling on operator interface 82.

In addition to the costing function of the present technique, controller 48 preferably stores a threshold value for the trash rack coefficient or the cost value and periodically compares the current value for the coefficient or cost value to the threshold value. The threshold value, corresponding to a limit of acceptable trash rack losses, will typically be set by operations personnel based upon desired performance of the facility. When the current value of the coefficient or cost value exceeds the reference level, controller 48 will output a signal to operator interface 82 to produce a visual or audible alarm signaling the need to clean the trash rack or, in the more extreme case, a higher order alarm or unit shutdown command signal may be output. Such comparisons may also serve as a basis for engaging an automatic cleaning system to remove debris from the trash rack.

What is claimed is:

1. A method for monitoring losses in a hydroelectric power generation facility, the facility including a turbine driven power generating unit receiving flow through an upstream conduit and a trash rack disposed upstream of the conduit to prevent debris from flowing into the unit, the method comprising the steps of:

(a) monitoring a first parameter representative of head loss across the trash rack;

(b) monitoring a second parameter representative of flow rate through the conduit; and (c) deriving a trash rack loss parameter from the first and the second parameters.

2. The method of claim 1, wherein the trash rack loss parameter is directly proportional to head loss across the trash rack and inversely proportional to the square of the flow rate through the conduit.

3. The method of claim 1, wherein the trash rack loss parameter is derived in accordance with the relationship:

$$K_T=2g(A_T)^2(H_1-H_2)/Q^2;$$

where $K_T$ is the trash rack loss parameter, g is a gravitational constant, $A_T$ is an intake flow area for the trash rack, $H_1$ is head upstream from the trash rack, $H_2$ is head downstream from the trash rack and Q is the intake volumetric flow rate.

4. The method of claim 1, comprising the further step of displaying the trash rack loss parameter on an operator interface.

5. The method of claim 1, comprising the further step of converting the trash rack loss parameter to an economic cost factor.

6. The method of claim 5, wherein the economic cost factor R is derived from the trash rack loss parameter in accordance with the relationship:

$$R=[(K_T-K_C)(Q/A_T)^2PE]/[2g(HW-TW)_{avg}];$$

where $K_T$ is the trash rack loss parameter, $K_c$ is an intake loss coefficient for the trash rack when clean, Q is the intake volumetric flow rate, $A_T$ is an intake flow area for the trash rack, P is the average annual energy production for the facility, E is an economic energy unit cost, g is a gravitational constant, and $(HW-TW)_{avg}$ is the average gross head for the facility.

7. A method for monitoring losses in a hydroelectric power generation facility, the facility including a turbine driven power generating unit receiving flow through an upstream conduit and a trash rack disposed upstream of the conduit to prevent debris from flowing into the unit, the method comprising the steps of:

(a) detecting a first parameter representative of head upstream of the trash rack;

(b) detecting a second parameter representative of head downstream of the trash rack;

(c) detecting a third parameter representative of flow rate through the conduit; and (d) deriving a trash rack loss coefficient from the first, second and third parameters, the trash rack loss coefficient providing an indication of head loss across the trash rack independent of flow rate through the conduit.

8. The method of claim 7, wherein the trash rack coefficient is directly proportional to differential head across the trash rack and inversely proportional to the square of the flow rate.

9. The method of claim 7, comprising the further steps of generating a reference trash rack loss coefficient and deriving a fouling value representative of additional losses due to fouling of the trash rack from the trash rack loss coefficient and the reference trash rack loss coefficient.

10. The method of claim 7, wherein the first and second parameters are determined by pressure transducers situated on upstream and downstream sides of the trash rack, respectively.

11. The method of claim 7, wherein the first parameter is determined by detecting headwater elevation upstream of the trash rack and the second parameter is determined by a piezometer downstream of the trash rack.

12. The method of claim 7, wherein the trash rack loss coefficient is derived in accordance with the relationship:

$$K_T=2g(A_T)^2(H_1-H_2)/Q^2;$$

where $K_T$ is the trash rack loss coefficient, g is a gravitational constant, $A_T$ is an intake flow area for the trash rack, $H_1$ is head upstream from the trash rack, $H_2$ is head downstream from the trash rack and Q is the intake volumetric flow rate.

13. The method of claim 7, comprising the further step of displaying the trash rack loss coefficient on an operator interface.

14. The method of claim 7, comprising the further step of converting the trash rack loss coefficient to an economic cost factor.

15. The method of claim 14, wherein the economic cost factor R is derived from the trash rack loss coefficient in accordance with the relationship:

$$R=[(K_T-K_C)(Q/A_T)^2PE]/[2g(HW-TW)_{avg}];$$

where $K_T$ is the trash rack loss parameter, $K_C$ is an intake loss coefficient for the trash rack when clean, Q is the intake volumetric flow rate, $A_T$ is an intake flow area for the trash rack, P is the average annual energy production for the facility, E is an economic energy unit cost, g is a gravitational constant, and $(HW-TW)_{avg}$ is the average gross head for the facility.

16. The method of claim 15, wherein the economic energy unit cost varies over time.

17. A system for monitoring losses in a hydroelectric power generation facility, the facility including a turbine driven power generating unit receiving flow through an upstream conduit and a trash rack disposed upstream of the conduit to limit intrusion of debris into the unit, the system comprising:

a first sensor detecting a first parameter representative of head upstream of the trash rack and generating a first signal representative thereof;

a second sensor detecting a second parameter representative of head downstream of the trash rack and generating a second signal representative thereof;

a third sensor detecting a parameter representative of flow through the conduit and generating a third signal representative thereof; and a controller coupled to the first, second and third sensors, the controller processing the first, second and third signals to derive a trash rack loss signal representative of head loss across the trash rack.

18. The system of claim 17, further comprising an operator interface coupled to the controller, the controller generating an output signal for commanding the operator interface to generate an operator perceptible alarm when the head loss across the trash rack exceeds a predetermined threshold level.

19. The system of claim 17, wherein the controller is configured to compare the trash rack loss signal to a reference trash rack loss signal and to generate a fouling value based on the result of the comparison.

20. The system of claim 19, wherein the controller is further configured to generate a cost value based on the fouling value.

21. The system of claim 17, wherein the controller is coupled to sensors for a plurality of units in the facility and generates trash rack loss signals for each unit of the plurality of units.

* * * * *